US009491994B2

(12) United States Patent
Sherr

(10) Patent No.: US 9,491,994 B2
(45) Date of Patent: Nov. 15, 2016

(54) BAG HAVING AN EXPANDABLE POCKET

(75) Inventor: Lois Zaprzalka Sherr, Hong Kong (CN)

(73) Assignee: Lois Zaprzalka Sherr, Hong Kong (CN)

( * ) Notice: Subject to any disclaimer, the term of this patent is extended or adjusted under 35 U.S.C. 154(b) by 274 days.

(21) Appl. No.: 13/370,702

(22) Filed: Feb. 10, 2012

(65) Prior Publication Data

US 2012/0207407 A1 Aug. 16, 2012

Related U.S. Application Data

(60) Provisional application No. 61/442,987, filed on Feb. 15, 2011.

(51) Int. Cl.
*A45C 7/00* (2006.01)
*A45C 11/00* (2006.01)

(52) U.S. Cl.
CPC ..... *A45C 7/0068* (2013.01); *A45C 2011/003* (2013.01)

(58) Field of Classification Search
CPC .... A45C 7/0063; A45C 3/04; A45C 7/0068; A45C 2011/003; B65D 31/12; B65D 81/3261; B65D 33/2566; B65D 33/004; B65D 29/00
USPC ..... 383/2, 38, 40; 190/103–111
See application file for complete search history.

(56) References Cited

U.S. PATENT DOCUMENTS 1,787,706 A 1/1931 Stember
1,845,088 A * 2/1932 Hunerhoff ..... 206/315.5
2,539,051 A 1/1951 Benenfeld
2,721,596 A * 10/1955 Danneil ..... 150/106
4,085,873 A * 4/1978 Schweitzer ..... 294/142
4,729,460 A 3/1988 Kim
4,993,845 A * 2/1991 Faltynek ..... 383/40
5,080,206 A * 1/1992 Tawil ..... 190/103
5,316,388 A * 5/1994 Caligiuri ..... 383/127
5,524,754 A 6/1996 Hollingsworth
5,526,907 A * 6/1996 Trawick et al. ..... 190/111
5,797,529 A 8/1998 Lavine
5,851,069 A * 12/1998 Davoren ..... 383/38
6,067,813 A * 5/2000 Smith ..... 62/371
6,179,182 B1 * 1/2001 Hayes ..... 224/408
6,237,766 B1 5/2001 Hollingsworth
6,591,950 B1 7/2003 Scicluna
7,021,437 B2 * 4/2006 Ghiassi ..... 190/103
7,111,731 B2 * 9/2006 Pratt et al. ..... 206/315.5
7,232,018 B1 * 6/2007 Salander ..... 190/108
7,293,635 B2 11/2007 Repke et al.
7,588,146 B1 9/2009 Salander et al.
7,837,032 B2 * 11/2010 Smeltzer ..... 206/315.5
8,043,004 B2 * 10/2011 Mogil ..... 383/38
8,348,510 B2 * 1/2013 Mogil ..... 383/38
8,672,546 B2 * 3/2014 Jariwala et al. ..... 383/40
2007/0017947 A1 1/2007 Fenton et al.

(Continued)

*Primary Examiner* — Peter Helvey

(74) *Attorney, Agent, or Firm* — Finnegan, Henderson, Farabow, Garrett & Dunner LLP

(57) ABSTRACT

Embodiments of the present disclosure include a bag. The bag may include a first surface and an expandable portion coupled to the first surface. The expandable portion may include a compartment, wherein, in an extended position, a front surface of the expandable portion may be configured to extend away from the first surface, and, in a collapsed position, the front surface of the expandable portion may be configured to lay substantially flush with the first surface.

20 Claims, 12 Drawing Sheets

(56) References Cited

U.S. PATENT DOCUMENTS

2007/0090007 A1 4/2007 Ames
2007/0181626 A1 8/2007 Fenton et al.
2007/0272700 A1* 11/2007 Swartz et al. ..... 220/737
2007/0278234 A1* 12/2007 Mogil ..... 220/592.2
2010/0252383 A1 10/2010 Liu
2011/0142373 A1* 6/2011 Kong ..... 383/6
2013/0037431 A1* 2/2013 Lin ..... 206/278

* cited by examiner

BAG HAVING AN EXPANDABLE POCKET

CROSS-REFERENCE TO RELATED APPLICATION

This application claims the benefit of priority under 35 U.S.C. §119 to U.S. Provisional Patent Application No. 61/442,987, filed Feb. 15, 2011, which is incorporated herein by reference in its entirety.

FIELD OF THE DISCLOSURE

Embodiments of the present disclosure include a bag, and more particularly, a bag including an expandable pocket.

BACKGROUND OF THE DISCLOSURE

Various types of bags may include external pockets that may expand from the main body of the bag to provide increased capacity. The external pocket may include a gusset that may fold and unfold to collapse and expand the external pocket relative to the main body of the bag. The gusset may be maintained in the collapsed or folded state by a mechanical securing device extending from the main body, such as a zipper, fastener, buckle, or the like. To expand the external pocket, the gusset may be manually released from the securing device.

Manually collapsing and expanding the external pocket, however, may be cumbersome. Moreover, the combined assembly of the external pocket and the securing device, such as a zipper or a fastener, may contribute to a bulky and obtrusive bag body. The present disclosure is directed to improvements in the existing technology.

SUMMARY OF THE DISCLOSURE

In accordance with an embodiment, a bag may include a first surface and an expandable portion coupled to the first surface. The expandable portion may include a compartment, wherein, in an extended position, a front surface of the expandable portion may be configured to extend away from the first surface, and, in a collapsed position, the front surface of the expandable portion may be configured to lay substantially flush with the first surface.

In accordance with another embodiment, a bag may include a first surface, an expandable portion including a front surface, a back surface, and a compartment, wherein the compartment is formed between the front surface and the back surface, and a stretchable gusset. The stretchable gusset may be configured to couple the expandable portion to the first surface, wherein, in an extended position, the stretchable gusset may be configured to stretch and extend the front surface of the expandable portion away from the first surface, and wherein, in a collapsed position, the stretchable gusset may be biased to position the front surface of the expandable portion substantially flush with the first surface. In accordance with yet another embodiment, a bag may include a first surface and an expandable pocket. The expandable pocket may include a front panel, a stretchable gusset secured to the first surface and the front panel, and a compartment formed between the front panel and the stretchable gusset. In an extended position, the stretchable gusset may be configured to stretch and the expandable pocket may be configured to extend away from the first surface, and, in a collapsed position, the expandable pocket may be configured to lay substantially flush with the first surface.

DETAILED DESCRIPTION

Reference will now be made in detail to the exemplary embodiments of the present disclosure described above and illustrated in the accompanying drawings.

Figure 1:
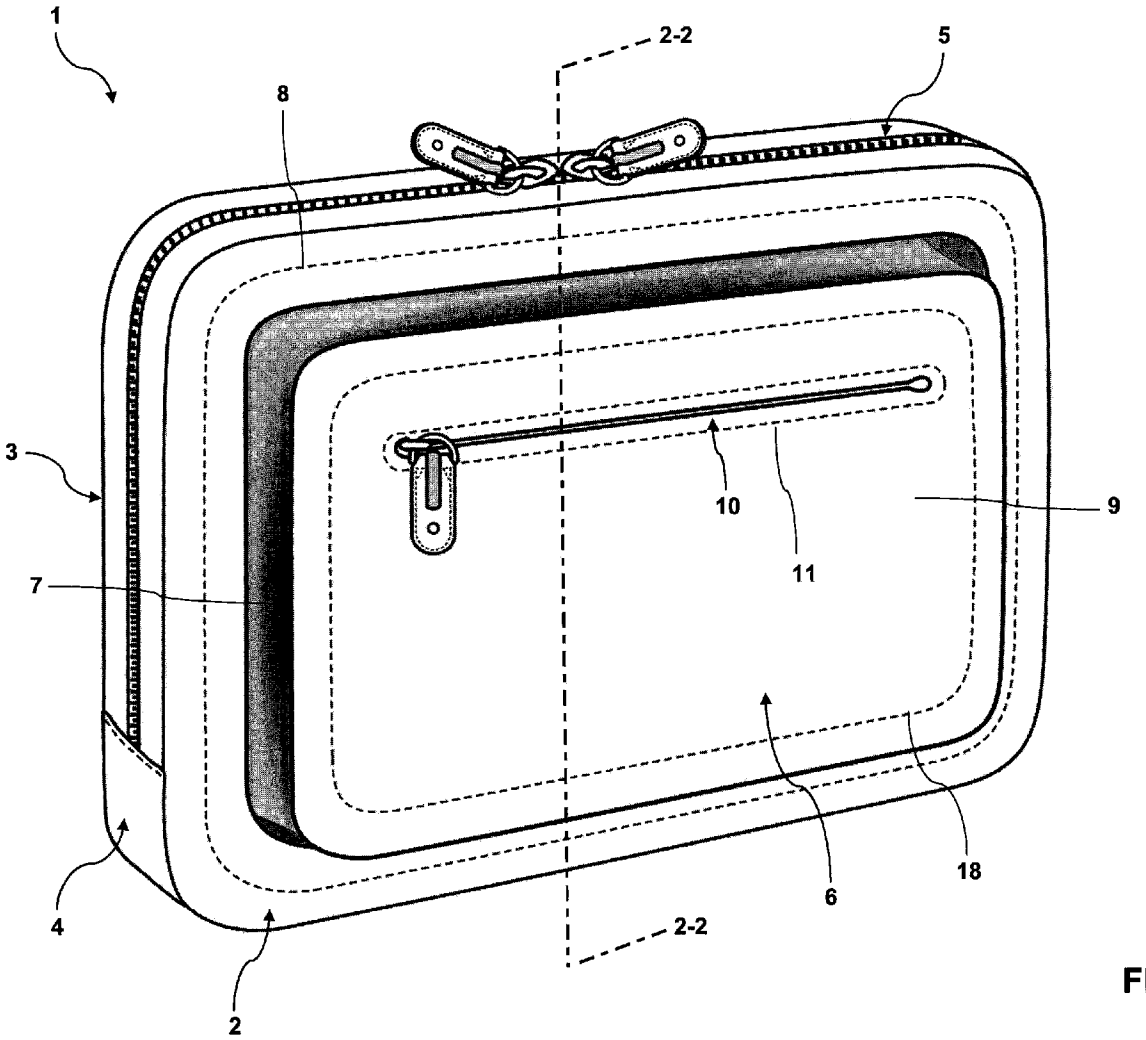
FIG. 1 illustrates a perspective view of a bag, according to an exemplary disclosed embodiment.

FIG. 1 is a perspective illustration of a bag 1, according to an exemplary embodiment. Bag 1 may be any suitable container or receptacle configured to house one or more items. Bag 1 may include a front face 2, a back face 3, a side wall 4, and a main fastener 5. Side wall 4 may be disposed between front face 2 and back face 3. Main fastener 5 may be positioned on side wall 4 to open and close bag 1 between front and back faces 2, 3. Main fastener 5 may include any suitable device configured to removably fasten front and back faces 2, 3. In the exemplary embodiments of the present disclosure, main fastener 5 may include a zipper assembly; however, it should be appreciated that in certain other embodiments, main fastener 5 may include one or more buttons, a Velcro® enclosure, or any other suitable hook-and-loop fastener system, snaps, latches, and the like.

Bag 1 may also include an expandable pocket 6. A stretchable gusset 7 may connect expandable pocket 6 to front face 2. Stretchable gusset 7 may be, for example, a flat sheet of an elastic or omnidirectional stretch material, such as neoprene, a synthetic or natural rubber, or any other suitable stretch material. Stretchable gusset 7 may be attached behind front face 2 by a first attachment joint 8. Stretchable gusset 7 may also be attached behind a front panel 9 of expandable pocket 6 by a second attachment joint 18. Accordingly, expandable pocket 6 may include a compartment 13 (FIG. 2) formed between front panel 9 and stretchable gusset 7 and bounded by second attachment joint 18. First and second attachment joints 8, 18 may include any suitable attachment means, such as, for example, stitching. It should be appreciated, however, that first and second attachment joints 8, 18 may include any other suitable attachment means, including, for example, glues, adhesives, fasteners, and the like.

It should also be appreciated that in certain embodiments, portions of bag 1 may include a substantially non-stretch material configured to provide strength and rigidity to bag 1. For example, front face 2, back face 3, and side wall 4 may be comprised of the substantially non-stretch material. Moreover, by being comprised of the substantially non-stretch material, front face 2 may provide a suitable rigid structure from which stretchable gusset 7 may stretch.

A pocket fastener 10 may be positioned, for example, within a perimeter defined by second attachment joint 18 and may be configured to open and close expandable pocket 6. In a similar manner as described above with respect to first and second attachment joints 8, 18, pocket fastener 10 may be fastened to front panel 9 of expandable pocket 6 by a third attachment joint 11. Pocket fastener 10 may also be positioned substantially parallel relative to an edge of second attachment joint 18. Moreover, and similar to main fastener 5, pocket fastener 10 may include any suitable device configured to readily open and close the entrance into expandable pocket 6, such as, for example, a zipper assembly. It should be appreciated, however, that in certain other embodiments, pocket fastener 10 may include one or more buttons, a Velcro® enclosure, or any other suitable hook-and-loop fastener system (FIG. 4), a snap enclosure, latches, a magnetic enclosure, and the like. Alternatively, pocket fastener 10 may be substituted with an open slot. Although pocket fastener 10 is illustrated as being positioned proximate a top edge of expandable pocket 6, it should be appreciated that pocket fastener 10 may be positioned anywhere else on expandable pocket 6. For example, pocket fastener 10 may be positioned on a lateral side or a bottom edge of expandable pocket 6. In addition, more than one pocket fastener 10 may be positioned anywhere on expandable pocket 6 to provide multiple entrances into expandable pocket 6.

Expandable pocket 6 may be positioned within a perimeter of front face 2 and may be configured to extend and collapse relative to front face 2. The exemplary embodiment of FIG. 1 illustrates expandable pocket 6 in an extended position. In the extended position, stretchable gusset 7 may stretch, thereby allowing expandable pocket 6 to extend from front face 2.

Although illustrated as positioned on front face 2 in FIG. 1, it should also be appreciated that expandable pocket 6 may be positioned on any other suitable location of bag 1. For example, expandable pocket 6 may be positioned on back face 3 or side wall 4. Moreover, expandable pocket 6 may extend across front face 2, side wall 4, and back face 3.

Figure 2:
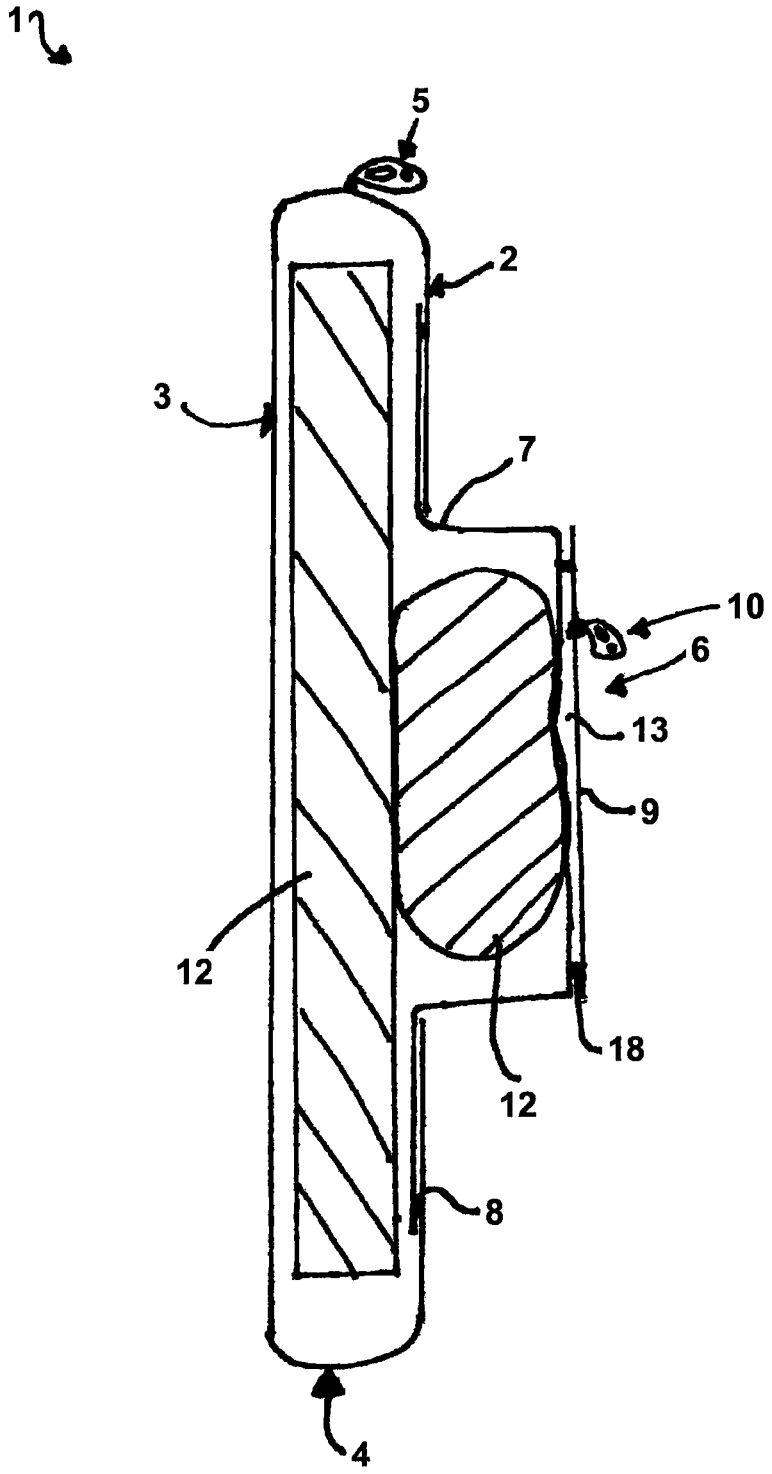
FIG. 2 illustrates a cross-sectional view of the bag in FIG. 1 taken along dashed line "2-2" of FIG. 1, according to an exemplary disclosed embodiment.

FIG. 2 illustrates a cross-sectional view of bag 1 taken along dashed line "2-2" of FIG. 1, according to an exemplary disclosed embodiment. FIG. 2 provides another exemplary illustration of expandable pocket 6 in the extended position. One or more items 12 may be stored inside bag 1. As shown in FIG. 2, stretchable gusset 7 may increase the storage capacity of bag 1 by stretching to conform to the shapes of items 12. In other words, items 12 may press up against the back of expandable pocket 6 and stretch stretchable gusset 7, thereby extending expandable pocket 6 and increasing a volume of space inside bag 1.

As alluded to above, and now illustrated in FIG. 2, expandable pocket 6 may include compartment 13 formed between front panel 9 and stretchable gusset 7, wherein additional items may be stored. FIG. 2 further illustrates first attachment joint 8, which may connect stretchable gusset 7 behind front face 2, and second attachment joint 18, which may connect front panel 9 of expandable pocket 6 to stretchable gusset 7. In other words, a back surface of compartment 13 may include stretchable gusset 7, a front surface of compartment 13 may include front panel 9, and the sides of compartment 13 may include the connection points between stretchable gusset 7 and front panel 9 at second attachment joint 18. Moreover, one or more items positioned inside compartment 13 may press up against one or both of front panel 9 and stretchable gusset 7 and may stretch stretchable gusset 7 relative to front panel 9 to increase room inside compartment 13.

In certain embodiments, compartment 13 may be formed between a front surface including front panel 9 and a back surface including an additional back panel formed of a material different than stretchable gusset 7. That is, the back panel may be a sheet of non-stretch material and may be positioned between front panel 9 and stretchable gusset 7. The back panel may be attached to stretchable gusset 7 or to front panel 9. For example, stretchable gusset 7 may contact and be attached to the back panel at only the peripheral edges of the back panel, or front panel 9 may contact and be attached to the back panel at only the peripheral edges of the back panel. In other embodiments, stretchable gusset 7 may substantially cover and be attached to an entire surface area of the back panel behind the back panel via, for example, a suitable adhesive. It should be appreciated, however, that compartment 13 may not include a back surface, and pocket fastener 10 may open into inner volume of bag 1.

Figure 3:
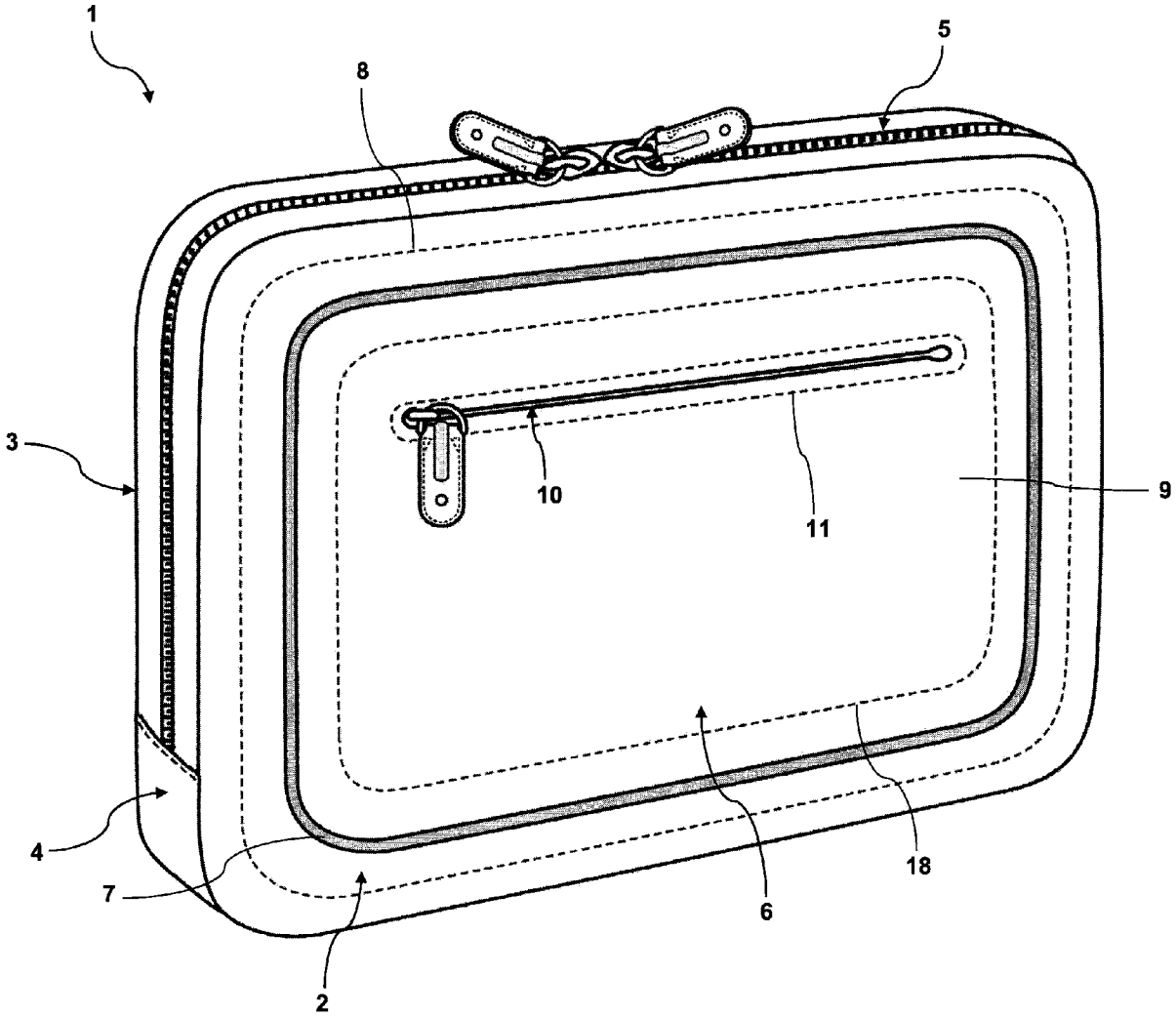
FIG. 3 illustrates another perspective view of the bag of FIG. 1, according to an exemplary disclosed embodiment.

FIG. 3 illustrates an exemplary embodiment of bag 1 with expandable pocket 6 in a collapsed position. In the collapsed position, expandable pocket 6 may be substantially flush with front face 2. In other words, front panel 9 of expandable pocket 6 and front face 2 may form a substantially flat exterior surface of bag 1 when expandable pocket 6 is in the collapsed position. Expandable pocket 6 may be biased in the collapsed configuration when no stretching force is applied to stretchable gusset 7, for example, when there are no items inside bag 1 or compartment 13, or when items inside bag 1 or compartment 13 do not sufficiently press against expandable pocket 6 to stretch stretchable gusset 7. The collapsed position of expandable pocket 6 may therefore automatically provide a flat and minimized profile for bag 1 when expansion is not necessary. In addition, since stretchable gusset 7 may be biased to hold expandable pocket 6 in the collapsed position, the peripheral edges of front panel 9 may be free from connection to front face 2 in the collapsed position. Moreover, the volume of space inside bag 1 may be larger when expandable pocket 6 is in the extended position than when expandable pocket 6 is in the collapsed position.

Figure 4:
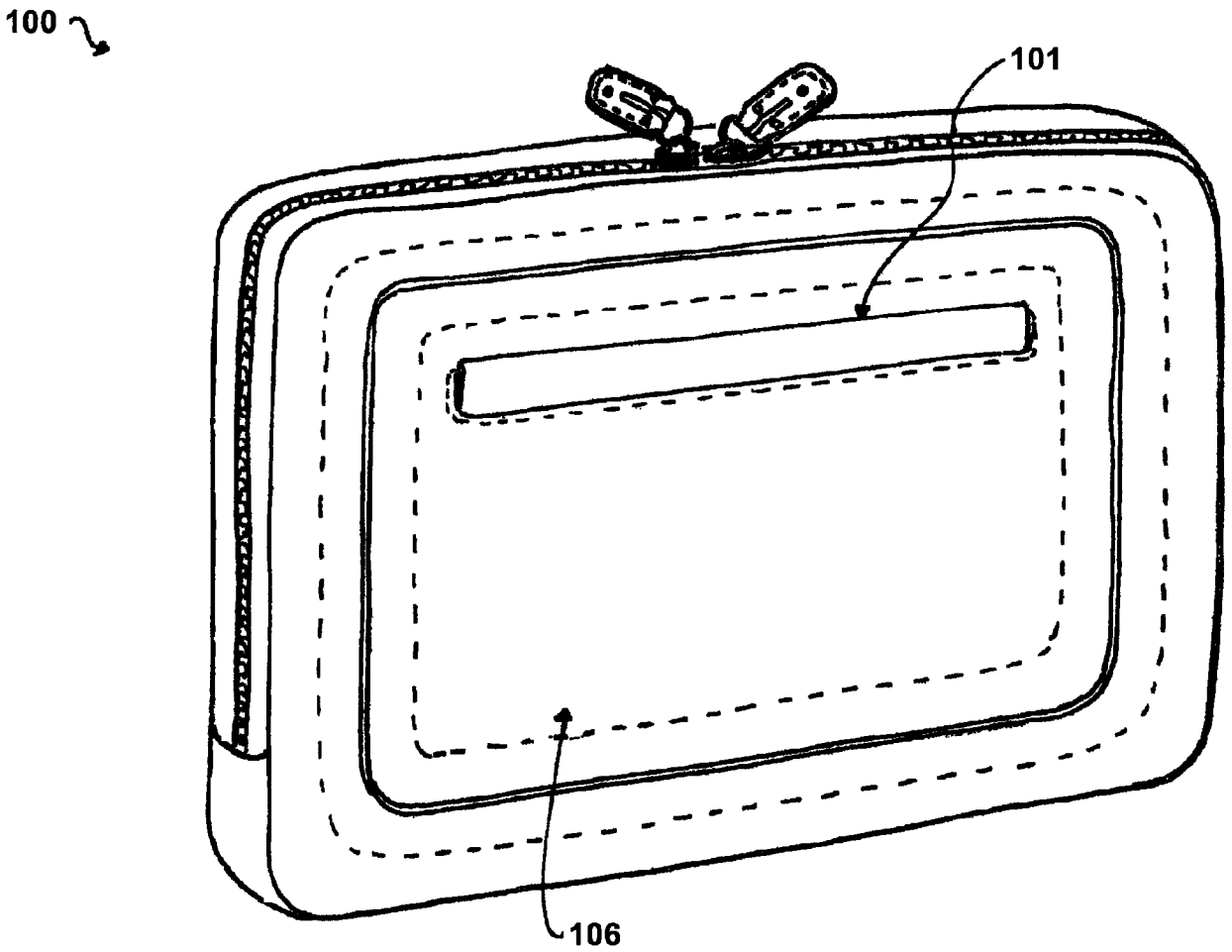
FIG. 4 illustrates a perspective view of another bag, according to an exemplary disclosed embodiment.

FIG. 4 illustrates an exemplary embodiment of a bag 100. Bag 100 may include similar, if not the same, features as bag 1 discussed above in FIGS. 1-3 with additional features. As alluded to above, and now illustrated in the exemplary embodiment of FIG. 4, an expandable pocket 106 of bag 100 may include a Velcro® enclosure 101 configured to open and close expandable pocket 106.

Figure 5:
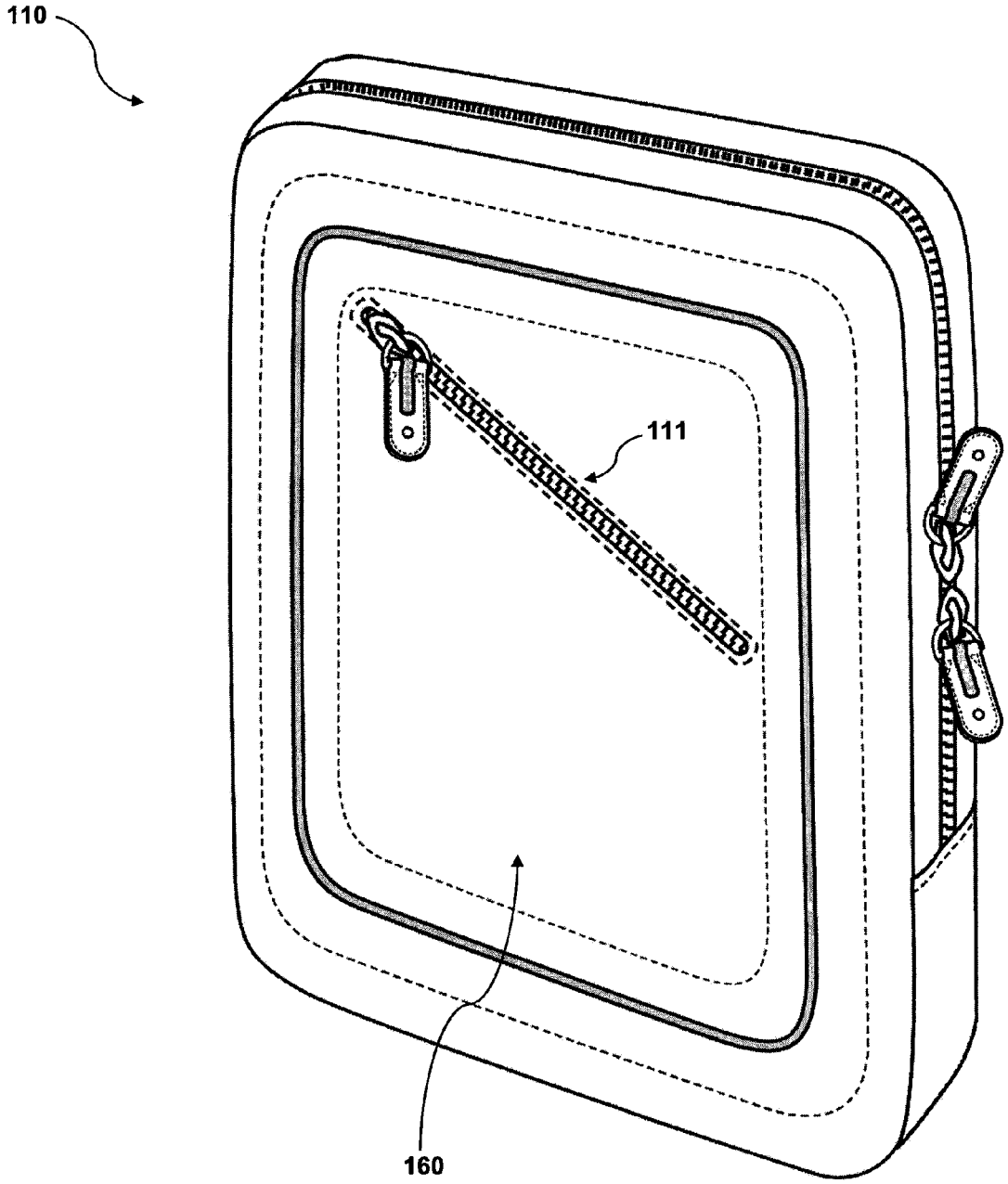
FIG. 5 illustrates a perspective view of another bag, according to an exemplary disclosed embodiment.

FIG. 5 illustrates an exemplary embodiment of a bag 110. Bag 110 may include similar, if not the same, features as bag 1 discussed above in FIGS. 1-3 with additional features. In the exemplary embodiment of FIG. 5, an expandable pocket 160 of bag 110 may include a pocket fastener 111 having a slanted configuration relative to an edge of expandable pocket 160. The slanted configuration of pocket fastener 111 is not limited to that illustrated in FIG. 5, and accordingly, pocket fastener 111 may be positioned at any suitable angle relative to an edge of expandable pocket 160. In the exemplary embodiment of FIG. 5, pocket fastener 111 may include a zipper assembly; however, it should be appreciated that in certain other embodiments, pocket fastener 160 may include one or more buttons, a Velcro® enclosure, or any other suitable hook-and-loop fastener system (FIG. 6), a snap enclosure, latches, a magnetic enclosure, and the like. Alternatively, pocket fastener 160 may be substituted with an open slot.

Figure 6:
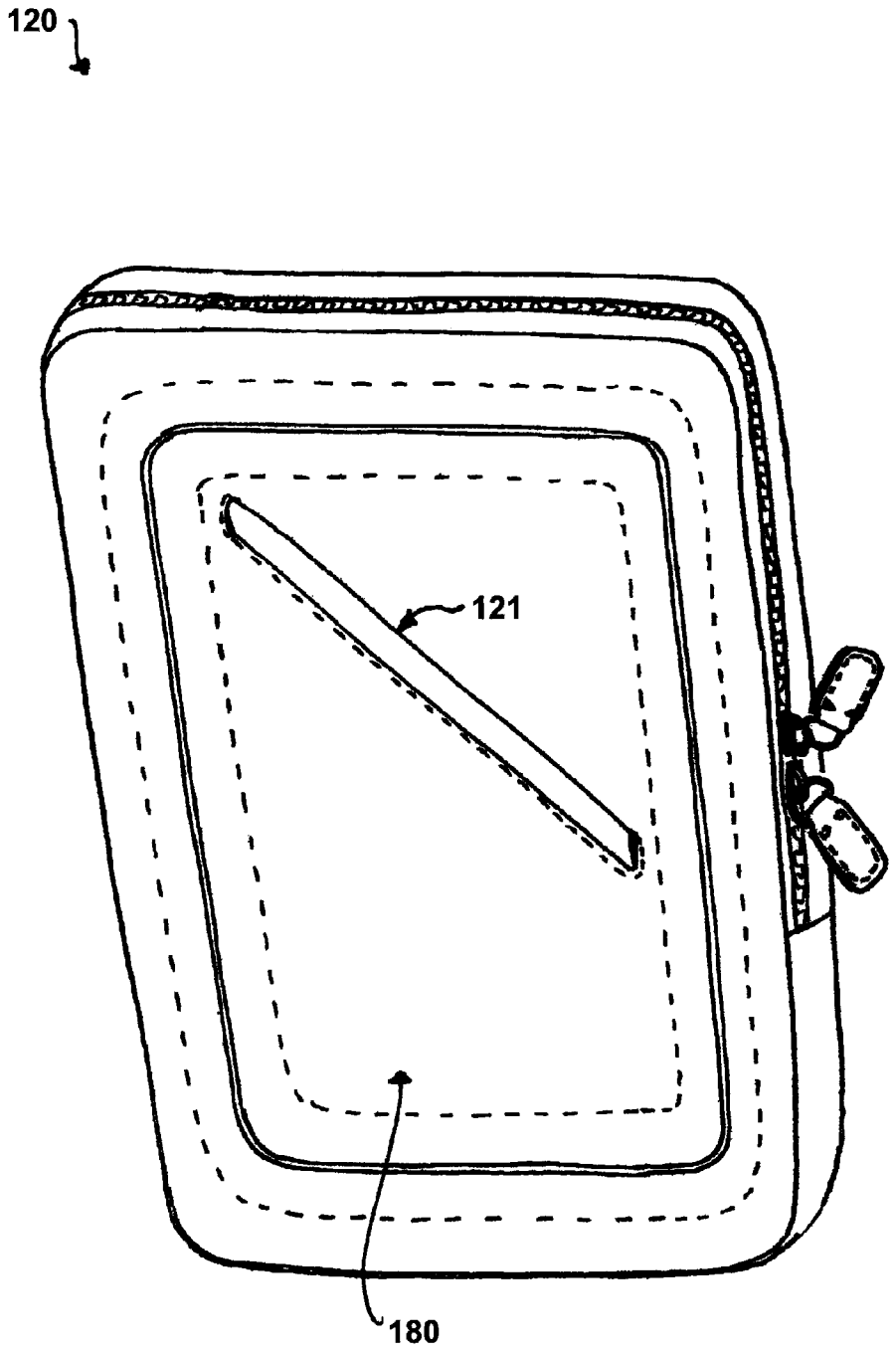
FIG. 6 illustrates a perspective view of another bag, according to an exemplary disclosed embodiment.

FIG. 6 illustrates an exemplary embodiment of a bag 120. Bag 120 may include similar, if not the same, features as bag 1 discussed above in FIGS. 1-3 and bag 110 discussed above in FIG. 5 with additional features. As alluded to above, and now illustrated in the embodiment of FIG. 6, an expandable pocket 180 of bag 120 may include a Velcro® enclosure 121 configured to open and close expandable pocket 180.

Figure 7:
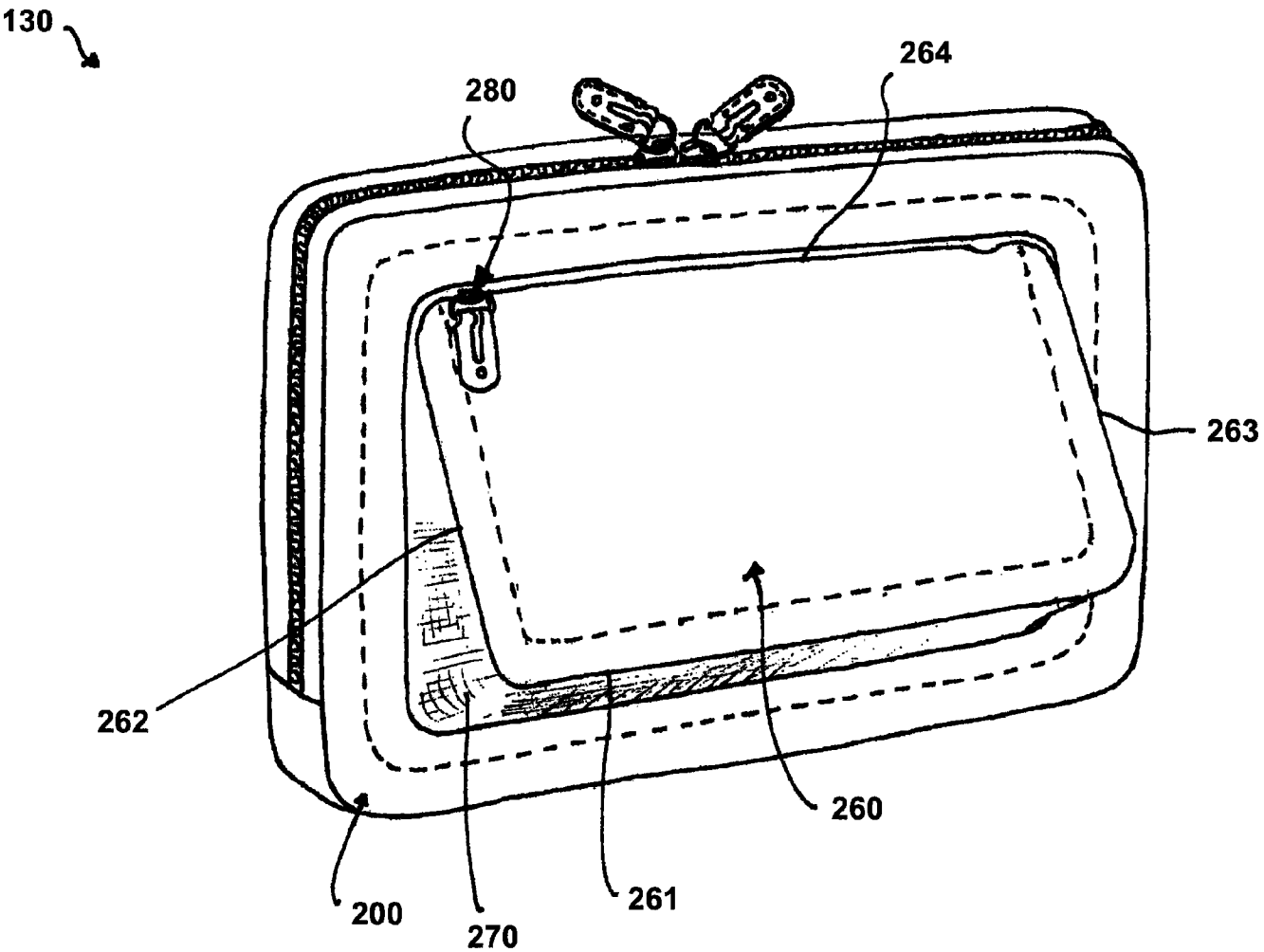
FIG. 7 illustrates a perspective view of another bag, according to an exemplary disclosed embodiment.

FIG. 7 illustrates an exemplary embodiment of a bag 130. Bag 130 may include similar, if not the same, features as bag 1 discussed above in FIGS. 1-3 with additional features. In the exemplary embodiment of FIG. 7, however, an expandable pocket 260 of bag 130 may partially extend from a front face 200 of bag 130. In other words, a bottom edge 261, a first side edge 262, and a second side edge 263 may extend from front face 200 when a stretchable gusset 270 is stretched. But because top edge 264 of expandable pocket 260 may be fastened to front face 200, top edge 264 may remain secured to front face 200 and may not extend from front face 200 when stretchable gusset 270 is stretched. Top edge 264 may be fastened to front face 200 by any suitable means, including, for example, stitching, glues, adhesives, and the like. In certain other embodiments, top edge 264 may be continuously formed with front face 200. A pocket fastener 280 may be configured to open and close expandable pocket 260, and may be, for example a zipper assembly. It should be appreciated, however, that in certain other embodiments, pocket fastener 280 may include one or more buttons, a Velcro® enclosure, or any other suitable hook-and-loop fastener system, a snap enclosure, latches, or a magnetic enclosure. Alternatively, pocket fastener 280 may be substituted for an open slot. As shown in FIG. 7, pocket fastener 280 may be positioned on top edge 264 of expandable pocket 260, but it should be appreciated that pocket fastener 280 may be positioned anywhere else on expandable pocket 260.

In other embodiments, one of bottom edge 261, first side edge 262, and second side edge 263 may be secured to front face 200 instead of top edge 264, and the unsecured edges of expandable pocket 260 may extend from front face 200 when stretchable gusset 270 is stretched.

Figure 8:
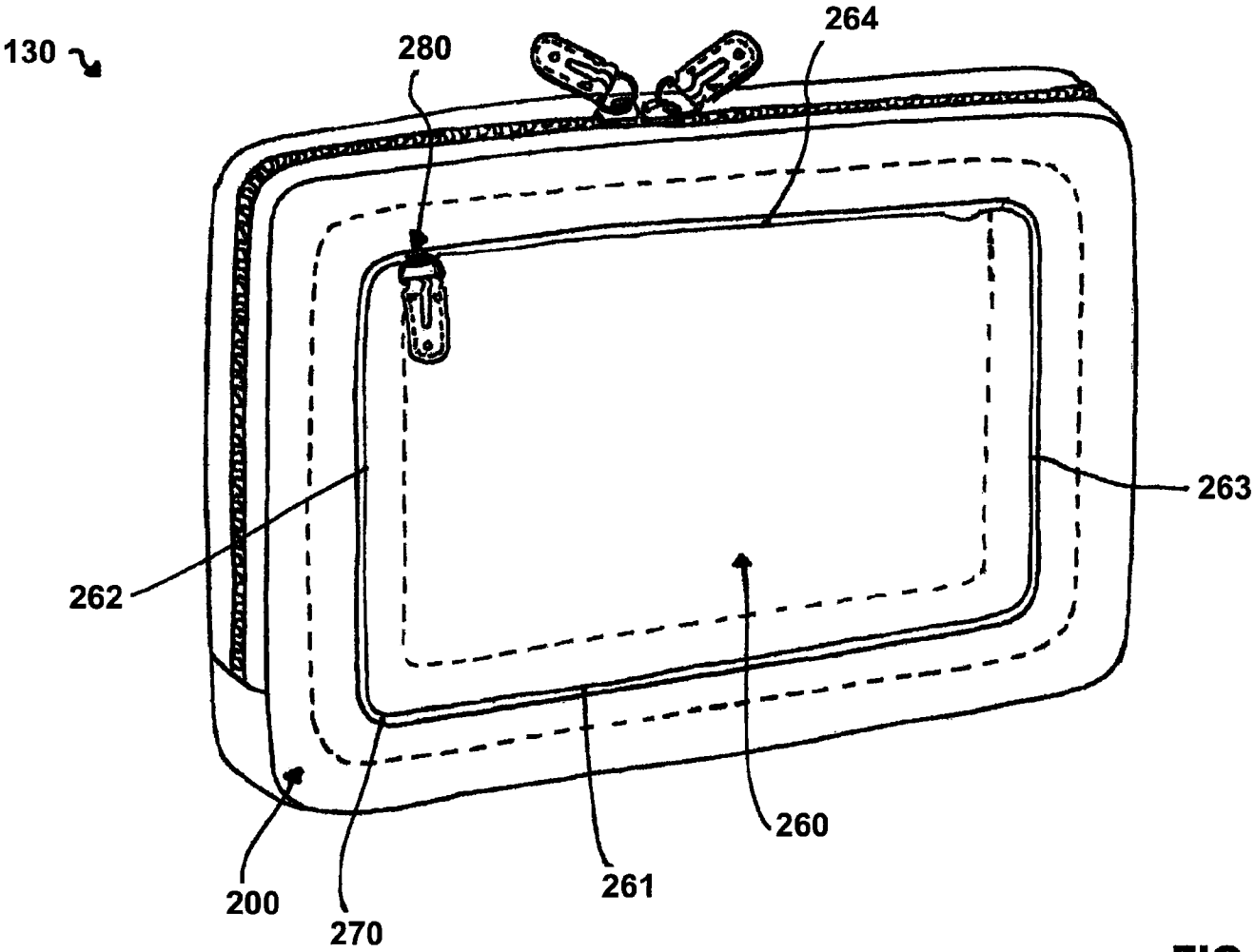
FIG. 8 illustrates another perspective view of the bag of FIG. 7, according to an exemplary disclosed embodiment.

FIG. 8 illustrates an exemplary embodiment of bag 130 with expandable pocket 260 in a collapsed configuration. Similar to the embodiments of FIGS. 3-6, in the collapsed position, expandable pocket 260 may be substantially flush with front face 200, thereby providing a substantially flat and minimized profile for bag 130.

Figure 9:
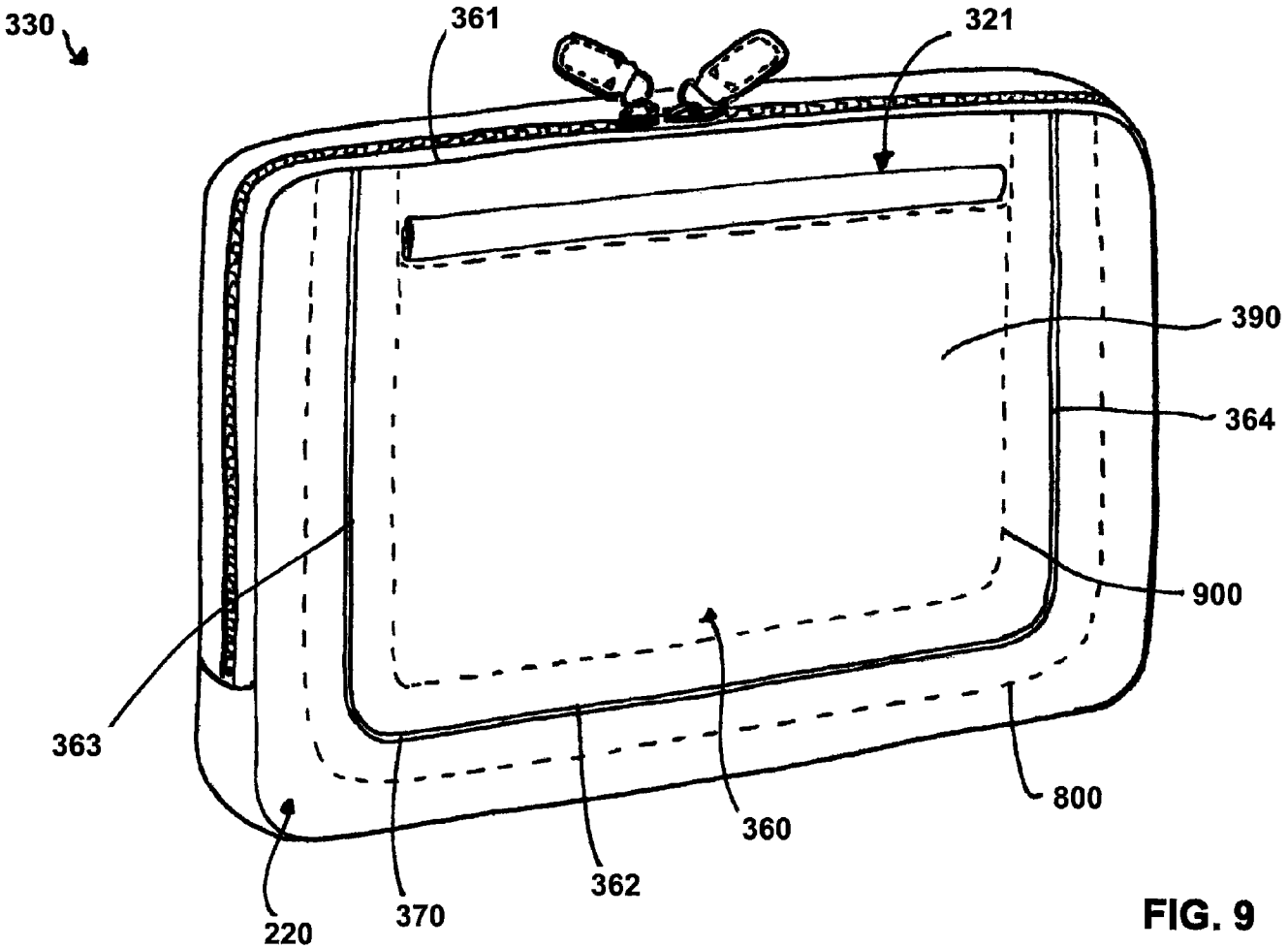
FIG. 9 illustrates a perspective view of yet another bag, according to an exemplary disclosed embodiment.

FIG. 9 illustrates an exemplary embodiment of a bag 330. Similar to bag 130 discussed above in the exemplary embodiments of FIGS. 7 and 8, an expandable pocket 360 of bag 330 may be partially extended from a front face 220. In addition, expandable pocket 360 may share a top edge 361 with front face 220. A first attachment joint 800 may connect a stretchable gusset 370 behind front face 220, and a second attachment joint 900 may connect a front panel 390 of expandable pocket 360 to stretchable gusset 370. Each of first attachment joint 800 and second attachment joint 900 may extend up to top edge 361. Accordingly, a bottom edge 362, a first side edge 363, and a second side edge 364 may extend from front face 220 when stretchable gusset 370 is stretched.

Moreover, expandable pocket 360 may include a pocket fastener 321 configured to open and close expandable pocket 360. As shown in FIG. 9, pocket fastener 321 may include a Velcro® enclosure, or any other suitable hook-and-loop fastener system; however, it should also be appreciated in certain other embodiments, pocket fastener 321 may include a zipper, one or more buttons, a snap enclosure, latches, a magnetic enclosure, and the like. Alternatively, pocket fastener 321 may be substituted with an open slot.

Figure 10:
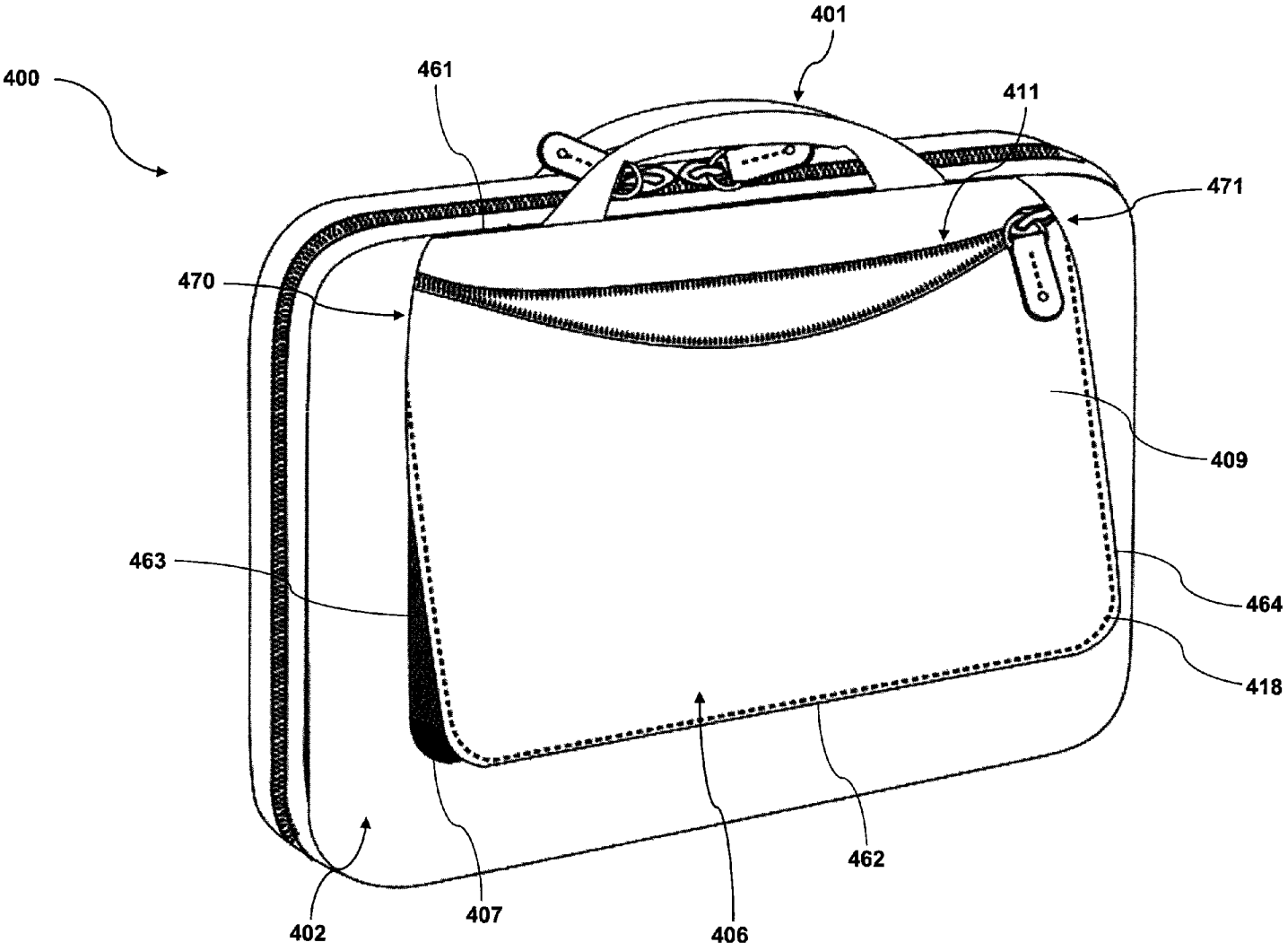
FIG. 10 illustrates a perspective view of yet another bag, according to an exemplary disclosed embodiment.
Figure 11:
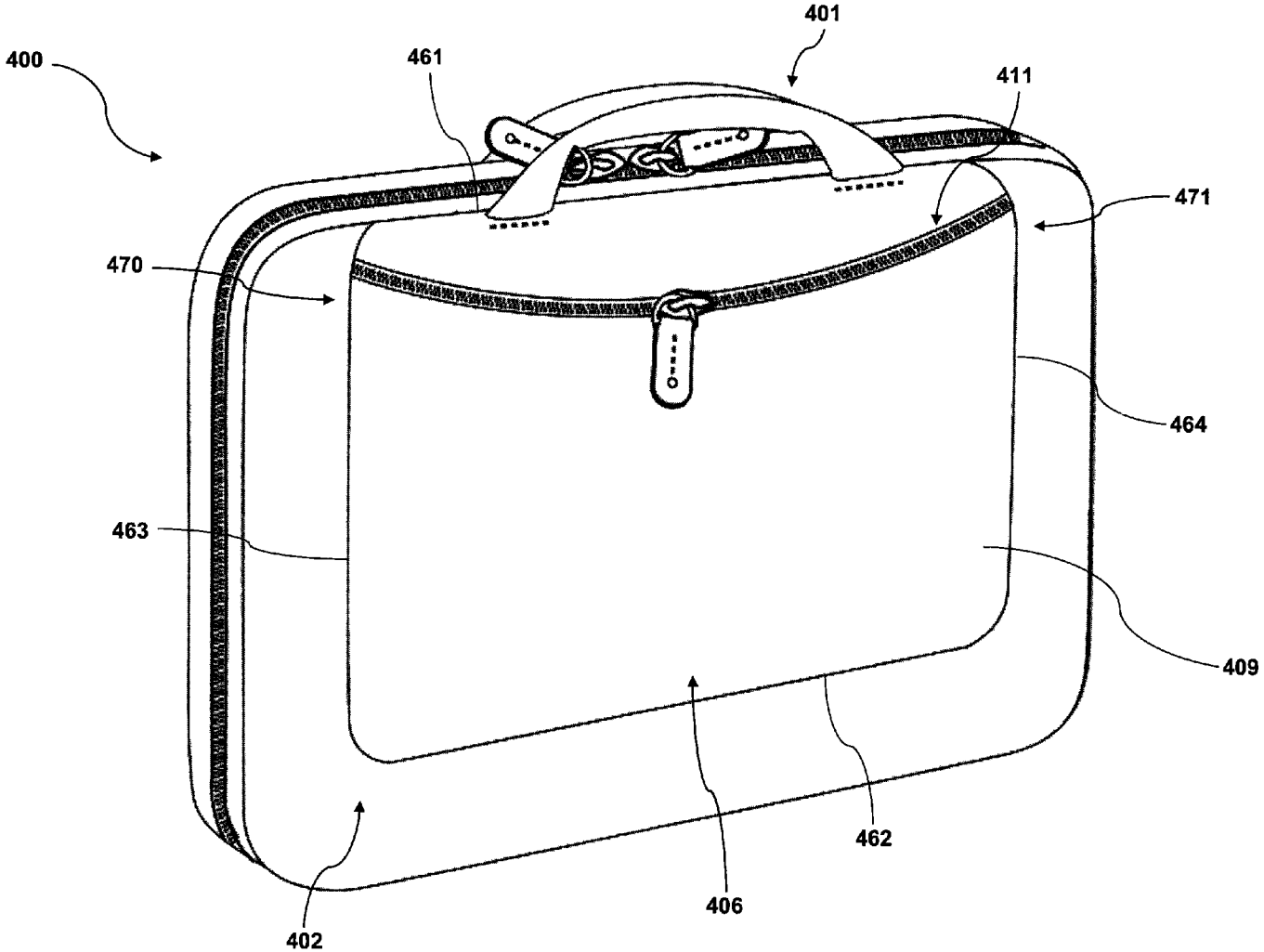
FIG. 11 illustrates another perspective view of the bag of FIG. 10, according to an exemplary disclosed embodiment.
Figure 12:
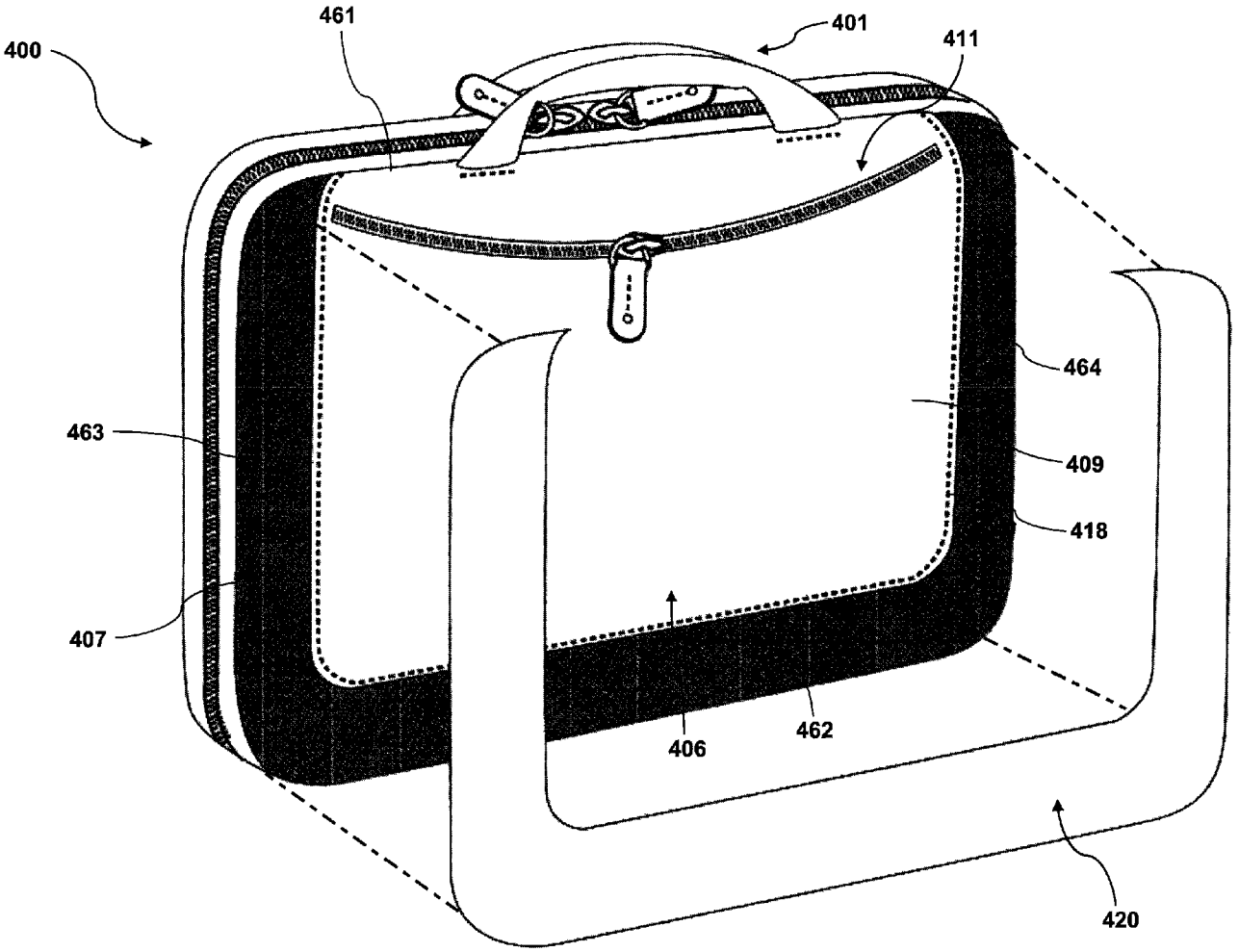
FIG. 12 illustrates a partially disassembled view of the bag of FIG. 10, according to an exemplary disclosed embodiment.

FIGS. 10-12 illustrate an exemplary embodiment of a bag 400. Bag 400 may include similar, if not the same, features as bag 1 discussed above in FIGS. 1-3 and bag 330 discussed above in FIG. 9. As shown in FIGS. 10-11, an expandable pocket 406 of bag 400 may be partially extended from a front face 402 (FIG. 10) and may be collapsed to be substantially flush with front face 402. Moreover, expandable pocket 406 may share a top edge 461 with front face 402. An attachment joint 418 may connect a front panel 409 of expandable pocket 360 to a stretchable gusset 407. Attachment joint 418 may extend up to top edge 461, and a peripheral portion 420 of front face 402 may be attached to a portions of front panel 409 (FIG. 12). More particularly, peripheral portion 420 may be attached to front panel 409 at a first top portion 470 and a second top portion 471. Accordingly, a bottom edge 462, a first side edge 463, and a second side edge 461 may extend from front face 402 when stretchable gusset 407 is stretched, but top edge 461, first top portion 470, and second top portion 471 may be restricted from extending from front face 402.

Expandable pocket 406 may include a pocket fastener 411 configured to open and close expandable pocket 406. As shown in FIGS. 10-12, pocket fastener 411 may include a zipper assembly and may have a curved configuration. It should also be appreciated that in certain other embodiments, pocket fastener 411 may include a Velcro® enclosure, or any other suitable hook-and-loop fastener system, one or more buttons, a snap enclosure, latches, a magnetic enclosure, and the like. Alternatively, pocket fastener 411 may be substituted with an open slot.

Bag 400 may further include a handle 401. Handle 401 may provide the ability for a user to grasp and hold bag 400, and may be positioned on a top portion of bag 400. Handle 400 may be integrally formed with bag 400, or in other embodiments, may be separate components fastened to bag 400 by any suitable means.

FIG. 12 illustrates a partially disassembled view of bag 400. As shown in FIG. 12, stretchable gusset 407 may extend to the outer boundaries of bag 400, and front panel 409 of expandable pocket 360 may be attached to stretchable gusset 407 via attachment joint 418. As alluded to above, peripheral portion 420 of front face 402 may be attached to stretchable gusset 407 partially around front panel 409, and may be directly attached to first top portion 470 and second top portion 471 of front panel 409 (FIG. 10). Although illustrated as two separate pieces, it should also be appreciated that stretchable gusset 407 may be a single, unitary piece of material.

As will be appreciated by one of ordinary skill in the art, the presently disclosed bag and expandable pocket may obviate the need for a user to manually extend or collapse the expandable pocket when loading items into the bag. Mechanical securing devices, such as zippers, buckles, and fasteners, are not necessary to maintain the expandable pocket in the collapsed position since the stretchable gusset may be biased to hold the expandable pocket in the collapsed position. The absence of such a securing device may also minimize the materials and construction of the bag. Moreover, the stretchable gusset and the substantially flush relationship between the expandable pocket and the front face of the bag in the collapsed position may automatically provide a minimized profile for the bag when expansion is not necessary.

Any aspect set forth in any embodiment may be used with any other embodiment set forth herein. Moreover, the features set forth herein may be used with any suitable bag, such as, for example, computer sleeves, portfolios, backpacks, purses, messenger bags, and luggage bags.

The many features and advantages of the present disclosure are apparent from the detailed specification, and thus, it is intended by the appended claims to cover all such features and advantages of the present disclosure which fall within the true spirit and scope of the present disclosure. Further, since numerous modifications and variations will readily occur to those skilled in the art, it is not desired to limit the present disclosure to the exact construction and operation illustrated and described, and accordingly, all suitable modifications and equivalents may be resorted to, falling within the scope of the present disclosure.

What is claimed is:

1. A bag, comprising:

a first surface;

an expandable portion coupled to the first surface, the expandable portion including a compartment, wherein, in an extended position, a front panel of the expandable portion is configured to extend away from the first surface, and, in a collapsed position, the front panel of the expandable portion is configured to lay substantially flush with the first surface;

wherein the first surface is in a first position when the front panel is in the collapsed position, and wherein the first surface is configured to remain in the first position when the front panel is extended from the collapsed position to the extended position;

wherein the expandable portion is biased toward the collapsed position; and wherein the front panel includes a first edge, a second edge, a third edge, and a fourth edge, and wherein, in the extended position, one of the first edge, the second edge, the third edge, and the fourth edge is fixed to the first surface, and at least one of the other of the first edge, the second edge, the third edge, and the fourth edge are configured to extend away from the first surface.

2. The bag of claim 1, further comprising a stretchable gusset configured to couple the expandable portion to the first surface.

3. The bag of claim 2, wherein, in the extended position, the stretchable gusset is configured to stretch and extend the front panel of the expandable portion from the first surface, and, in the collapsed position, the stretchable gusset is configured to position the front panel of the expandable portion substantially flush with the first surface.

4. The bag of claim 3, wherein a volume of space inside the bag is larger when the expandable portion is in the extended position than when the expandable portion is in the collapsed position.

5. The bag of claim 2, wherein the compartment of the expandable portion is formed between the front panel and a portion of the stretchable gusset.

6. The bag of claim 5, wherein the front panel of the expandable portion is coupled to the stretchable gusset.

7. The bag of claim 2, wherein a portion of stretchable gusset is positioned behind the first surface.

8. The bag of claim 2, wherein the stretchable gusset is formed of neoprene.

9. A bag, comprising:

a first surface;

an expandable portion including a front surface, a back surface, and a compartment, wherein the compartment is formed between the front surface and the back surface;

a stretchable gusset configured to couple the expandable portion to the first surface, wherein, in an extended position, the stretchable gusset is configured to stretch and extend the front surface of the expandable portion away from the first surface, and wherein, in a collapsed position, the stretchable gusset is biased to position the front surface of the expandable portion substantially flush with the first surface;

wherein the first surface is in a first position when the stretchable gusset is in the collapsed position, and wherein the first surface is configured to remain in the first position when the stretchable gusset is extended from the collapsed position to the extended position; and wherein the expandable portion includes a first edge, a second edge, a third edge, and a fourth edge, and wherein, in the extended position, one of the first edge, the second edge, the third edge, and the fourth edge is fixed to the first surface, and at least one of the other of the first edge, the second edge, the third edge, and the fourth edge are configured to extend away from the first surface.

10. The bag of claim 9, wherein the back surface includes a portion of the stretchable gusset.

11. The bag of claim 9, wherein a volume of space inside the bag is larger when the expandable portion is in the extended position than when the expandable portion is in the collapsed position.

12. The bag of claim 11, wherein the hack surface of the expandable portion is configured to separate the volume of space inside the bag from the compartment.

13. The bag of claim 12, further comprising a first fastener configured to open into the volume of space inside the bag, and a second fastener configured to open into the compartment.

14. A bag, comprising:

a first surface;

an expandable pocket including:

a front panel;

a stretchable gusset secured to the first surface and the front panel; and a compartment formed between the front panel and the stretchable gusset;

wherein, in an extended position, the stretchable gusset is configured to stretch and the expandable pocket is configured to extend away from the first surface, and, in a collapsed position, the expandable pocket is configured to lay substantially flush with the first surface;

wherein the first surface is in a first position when the stretchable gusset is in the collapsed position, and wherein the first surface is configured to remain in the first position when the stretchable gusset is extended from the collapsed position to the extended position;

wherein the stretchable gusset is biased toward the collapsed position; and wherein the front panel includes a first edge, a second edge, a third edge, and a fourth edge, and wherein, in the extended position, one of the first edge, the second edge, the third edge, and the fourth edge is fixed to the first surface, and at least one of the other of the first edge, the second edge, the third edge, and the fourth edge are configured to extend away from the first surface.

15. The bag of claim 14, wherein, in the collapsed position, the stretchable gusset is biased to position the front panel of the expandable pocket substantially flush with the first surface.

16. The bag of claim 14, wherein a volume of space inside the bag is larger when the expandable pocket is in the extended position than when the expandable portion is in the collapsed position.

17. The bag of claim 14, wherein a portion of stretchable gusset is positioned behind the first surface.

18. The bag of claim 14, wherein the stretchable gusset is configured to separate a volume of space inside the bag from the compartment.

19. The bag of claim 1, further comprising a first fastener configured to open into the volume of space inside the bag, and a second fastener configured to open into the compartment.

20. The bag of claim 14, further comprising a first fastener configured to open into the volume of space inside the bag, and a second fastener configured to open into the compartment.

* * * * *